US008951016B2

(12) United States Patent
Ahmad et al.

(10) Patent No.: US 8,951,016 B2
(45) Date of Patent: Feb. 10, 2015

(54) ROTOR BLADE FOR AN AXIAL FLOW TURBOMACHINE AND MOUNTING FOR SUCH A ROTOR BLADE

(75) Inventors: Fathi Ahmad, Kaarst (DE); Günther Walz, Mülheim an der Ruhr (DE)

(73) Assignee: Siemens Aktiengesellschaft, München (DE)

( * ) Notice: Subject to any disclaimer, the term of this patent is extended or adjusted under 35 U.S.C. 154(b) by 458 days.

(21) Appl. No.: 13/378,453

(22) PCT Filed: Jun. 17, 2010

(86) PCT No.: PCT/EP2010/058508

§ 371 (c)(1),
(2), (4) Date: Dec. 15, 2011

(87) PCT Pub. No.: WO2010/149555

PCT Pub. Date: Dec. 29, 2010

(65) Prior Publication Data

US 2012/0093654 A1 Apr. 19, 2012

(30) Foreign Application Priority Data

Jun. 23, 2009 (EP) ..... 09008226

(51) Int. Cl.
*F03B 3/12* (2006.01)
*F04D 29/34* (2006.01)
*F01D 5/30* (2006.01)

(52) U.S. Cl.
CPC ..... *F01D 5/3007* (2013.01)
USPC ..... 416/219 R; 416/248

(58) Field of Classification Search
CPC ..... F01D 5/3007; F01D 5/3015; F01D 5/326; F01D 5/3092; F04D 29/34; F04D 25/088
USPC ..... 416/219 R, 220 R, 248, 217, 220 A, 416/219 A
See application file for complete search history.

(56) References Cited

U.S. PATENT DOCUMENTS

| | | | | |
|---|---|---|---|---|
| 1,890,581 | A | 12/1932 | Kohler | |
| 2,781,998 | A | 2/1957 | Barr | |
| 5,067,876 | A | 11/1991 | Moreman, III | |
| RE33,954 | E * | 6/1992 | Honda et al. | 416/219 R |

(Continued)

FOREIGN PATENT DOCUMENTS

| | | |
|---|---|---|
| DE | 4108930 A1 | 10/1991 |
| EP | 0502660 A1 | 9/1992 |

(Continued)

OTHER PUBLICATIONS

"Stiffer Circumferential Dovetail Mount for Turbine blades", NTIS Tech Notes, US Department of Commerce, Springfield, VA, Aug. 1, 1992, pp. 585, XP000325273, ISSN: 0889-8464.

*Primary Examiner* — Edward Look
*Assistant Examiner* — Christopher J Hargitt

(57) ABSTRACT

A rotor blade for an axial flow turbomachine, preferably a turbine, and to a mounting for such a rotor blade is provided. In the rotor blade, the two opposing lateral walls of the blade base are continuously curved along their extension between platform and bottom side of the blade base in order to reduce the mechanical load in the blade base and that of the walls supporting the blade base of a rotor.

10 Claims, 2 Drawing Sheets

(56) References Cited

U.S. PATENT DOCUMENTS

| | | | | |
|---|---|---|---|---|
| 5,222,865 | A | 6/1993 | Corsmeier | |
| 6,019,580 | A | 2/2000 | Borns | |
| 6,065,938 | A | 5/2000 | Bartsch | |
| 7,503,751 | B2 * | 3/2009 | Arrieta | 416/219 R |
| 2004/0253113 | A1 | 12/2004 | Follonier et al. | |

FOREIGN PATENT DOCUMENTS

| | | | |
|---|---|---|---|
| EP | 1489266 | | 12/2004 |
| GB | 316070 | A | 7/1929 |
| GB | 813144 | A | 5/1959 |
| GB | 2372784 | A | 9/2002 |
| JP | 59110214 | | 6/1984 |
| JP | 59229002 | | 11/1984 |
| JP | 6001939 | | 1/1994 |
| JP | 2004211696 | A | 7/2004 |
| JP | 4224203 | B2 | 2/2009 |
| JP | 2010048523 | A | 3/2010 |
| JP | 5071305 | B2 | 11/2012 |
| WO | WO 9749921 | A1 | 12/1997 |
| WO | WO 9942703 | A1 | 8/1999 |

* cited by examiner

ROTOR BLADE FOR AN AXIAL FLOW TURBOMACHINE AND MOUNTING FOR SUCH A ROTOR BLADE

CROSS REFERENCE TO RELATED APPLICATIONS

This application is the US National Stage of International Application No. PCT/EP2010/058508, filed Jun. 17, 2010 and claims the benefit thereof. The International Application claims the benefits of European Patent Application application No. 09008226.4 EP filed Jun. 23, 2009. All of the applications are incorporated by reference herein in their entirety.

FIELD OF INVENTION

The invention refers to a rotor blade for an axial flow turbomachine, comprising in succession a curved blade airfoil, a platform and a blade root with two mutually opposite sidewalls which diverge from the platform towards a blade underside. In addition, the invention refers to a mounting for such a rotor blade.

BACKGROUND OF INVENTION

Rotor blades for turbomachines, such as turbines and compressors, and also their mountings, are widely known from the prior art. For example, it is known that rotor blades have a root section with an essentially dovetail-like appearance, wherein the two mutually opposite sidewalls of the blade root diverge rectilinearly from the platform in the direction towards a blade root underside. For fastening, a rotor, which carries these rotor blades, in most cases has a shaft collar or a correspondingly formed rotor disk, on the generated surface of which retaining grooves—with a contour corresponding to the blade root—extend in the axial direction. The rotor blades can be inserted by their dovetail-shaped blade root into the corresponding retaining grooves and, on account of the dovetail connection created in this way, are securely retained against disengagement in the radial direction during rotation of the rotor.

For example, such a blade fastening is known from DE 41 08 930 A1. In order to achieve the service life limit values with regard to fatigue with low and high stress cycle numbers in this case, it is provided that the dovetail hook-in fastening is a section of a helix. Furthermore, a rectilinear—but inclined in relation to the radial direction of the turbine rotor—dovetail root of a rotor blade is known from EP 0 502 660 A1. This arrangement, however, is provided only for non-metallic blades.

In addition, it is known from the prior art to fasten rotor blades on rotor disks by means of so-called fir tree toothing. To this end, both the blade root of a rotor blade and the retaining groove, which is formed correspondingly to it, have contours with an appearance corresponding to a fir tree. The undercuts and projections which are thereby provided and inter-engage can give rise to stresses in the material of the rotor disk or of the rotor blade root in the event of high centrifugal force load on account of the rotor rotating at high speed, which can lead to fatigue phenomena.

SUMMARY OF INVENTION

The object of the invention therefore lies in the provision of an alternative, reliable fastening of rotor blades on the rotor of a turbomachine. A further object of the invention is the provision of an alternative, long-life mounting for such rotor blades.

The objects which faun the basis of the invention are achieved with a rotor blade according to the features of the claims and with a mounting according to the features of the claims. The rotor blade according to the invention comprises in succession a curved blade airfoil, a platform and a dovetail-shaped blade root with two mutually opposite sidewalls which diverge from the platform towards a blade root underside, wherein both sidewalls are curved, for the most part in the same direction, along their extent between the platform and the blade root underside, in such a way that a blade root center line, which is arranged in the middle between the two sidewalls, is curved in the corresponding direction, as seen in cross section. The mounting according to the invention for a rotor blade has a retaining groove in each case for each rotor blade which is to be mounted, the retaining groove having two mutually opposite sidewalls in each case which, for forming a dovetail shape, diverge from an outwardly oriented groove opening towards a groove base, wherein both sidewalls are curved, for the most part in the same direction, along their extent between the groove opening and the groove base in such a way that a fictive retaining groove center line, which is arranged in the middle between the two sidewalls, is curved in the corresponding direction, as seen in cross section.

The invention is based on the knowledge that a more highly loadable connection of the rotor blade and the rotor can be brought about by means of a blade root which curves from the platform towards the blade root underside. Production costs can also be reduced, particularly if the rotor blade is used in a turbine, since the otherwise customary fir tree connections can also be achieved by means of a dovetail connection which is curved according to the invention. The cost saving is achieved especially as a result of the lower number of projections and undercuts both for the blade root and for the axial retaining groove, which is formed correspondingly to it, on the rotor. Moreover, improved frequency damping can be achieved. Also, as a result of the blade root diverging from the platform towards a blade root underside, the center of gravity of such a blade can be shifted closer to the rotational axis of the rotor, as a result of which the load, especially the centrifugal force load, of the rotor caused by the weight of the blade is reduced. A particular advantage of the mounting is that notch stresses can be reduced at that transition from the groove base to the retaining groove sidewall which has a larger opening angle, i.e. a larger radius.

In this case, both sidewalls are curved for the most part in identical directions, i.e. one of the two sidewalls is for the most part concavely curved, whereas the opposite other sidewall is at least for the most part convexly curved.

At the same time, the two sidewalls diverge from the platform towards a blade root underside in order to ensure the thereby achieved dovetail shape for the radial hook-in fastening of the blade.

Advantageous developments are disclosed in the dependent claims.

According to an advantageous development, the curvature of that sidewall of the blade root, which in the rotational direction of a rotor of a turbomachine equipped with such a rotor blade is leading in relation to the other sidewall, is for the most part convex. Correspondingly, the curvature of that sidewall of the retaining groove, which in the rotational direction of a rotor of a turbomachine equipped with such a mounting is leading in relation to the other sidewall, is at least for the most part concave, and the curvature of that sidewall which is correspondingly trailing is for the most part convex. Both cases result in the flow forces—which act upon the blade airfoil—acting in the blade root connection in the circumferential direction in such a way that the rotor blade is moved more towards the groove base of the retaining groove. As a result of this, the steeples which are formed between the retaining grooves of the rotor experience a lower mechanical tensile stress than in the case of a curvature in the reverse direction. The trailing sidewall of the blade root is preferably for the most part concavely curved.

As a result of the lower mechanical load, the service life of the mounting or rotor disk and of the rotor blade can be extended.

The blade root, and correspondingly also the retaining groove of the mounting, can expediently also be curved in the axial direction in each case.

According to a further advantageous development, the two oppositely disposed bearing flanks of the blade root or of the retaining groove lie at least partially on different radii. As a result, a longer fictive failure crack length ensues, as a result of which a narrowing of the blade root is possible under the same loads.

BRIEF DESCRIPTION OF THE DRAWINGS

The invention is subsequently explained further with reference to a drawing.

In the drawing.

DETAILED DESCRIPTION OF INVENTION

Figure 1:
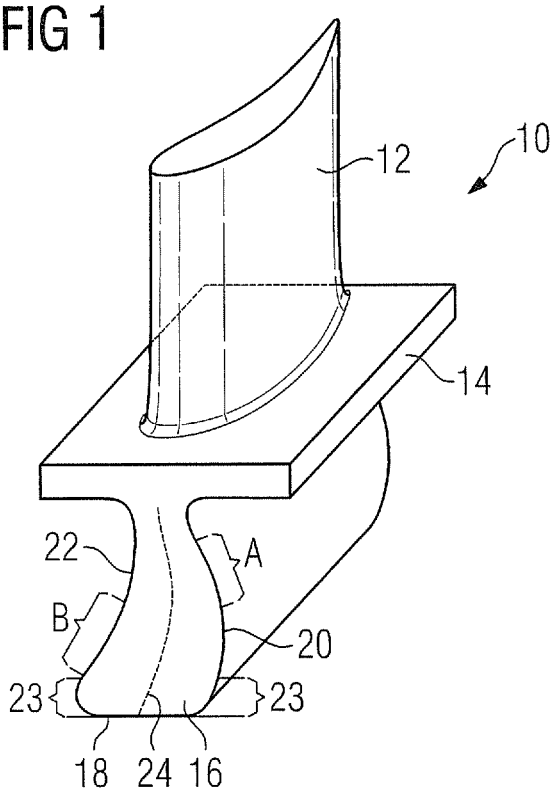
FIG. 1 shows a rotor blade according to the invention in a perspective, schematic view.

FIG. 1 shows in a perspective view a rotor blade 10 which pertains to the invention. The metallic rotor blade 10 comprises in succession a curved blade airfoil 12, a platform 14 and a blade root 16. The blade root 16 extends from the platform 14 towards a blade root underside 18. Moreover, the blade root 16 comprises two mutually opposite sidewalls 20, 22, the spacing of which becomes larger with increasing distance from the platform 14. The two sidewalls 20, 22 therefore diverge from the platform 14 towards the blade underside 18, wherein the rounded transition of the sidewalls 20, 22 to the blade underside 18 is altogether disregarded here.

A blade root center line 24, which extends in the middle between the two sidewalls 20, 22, is shown in the manner of a dashed line. Both the sidewall 20 and the sidewall 22 are continuously curved along their entire extent from the platform 14 to the blade root underside 18. As a result of this, the sidewall 20 has for the most part a convex shape and the sidewall 22 has for the most part a concave shape. Consequently, the result is that the blade root center line 24 is also curved along its extent from the platform 14 to the blade root underside 18. Consequently, the result is that the sidewalls 20, 22 are not curved in a mirror-image manner in relation to the blade root center line 24 but, as in the case of an optical divergent lens, rather in a concave-convex manner, apart from the totally diverging contour for forming the dovetail shape.

By using the term "for the most part", those significantly smaller sections 23 of the sidewalls 20, 22 which, as rounded transitions connect the sidewalls 20, 22 to the blade root underside 18, are excluded.

Figure 2:
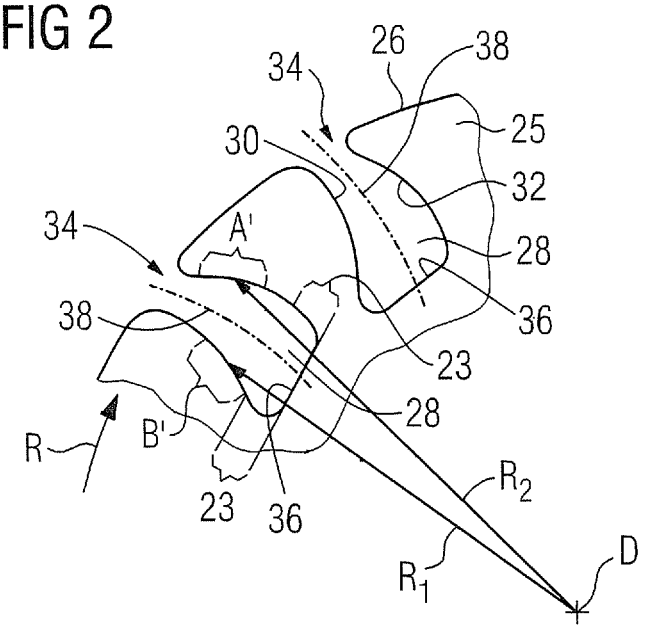
FIG. 2 shows in a side view a rotor disk with retaining grooves, suitable for holding a rotor blade according to the invention according to FIG. 1.

FIG. 2 shows the side view of a detail of a rotor disk 25 which is part of a rotor of a turbomachine and shows the mounting 29 for the rotor blades 10. The rotor disk 25, on its outer periphery 26, has retaining grooves 28 distributed uniformly over its periphery, of which only two are shown in FIG. 2. A rotor blade 10 can be inserted in each case into each retaining groove 28 in this case. The retaining groove 28 has an outwardly oriented groove opening 34, opposite which, radially on the inside, is a groove base 36. In most cases, the groove base 36 is of a flat construction.

The contour of the sidewalls 30, 32 of the retaining grooves 28 in this case basically corresponds to the contour which is predetermined by the two sidewalls

20, 22 of the blade root 16. As a result of this, the rotor blade can be inserted by its blade root 16 into the retaining groove 28 in a form-fitting manner.

The sidewalls 30, 32 of the retaining grooves 28 are correspondingly curved like the sidewalls 20, 22 of the blade root 16. The direction of curvature in the circumferential direction in this case is selected so that an essentially convexly curved sidewall 30 of the retaining groove 28 in the rotational direction R of the rotor or of the rotor disk 25 is trailing in relation to the sidewall 32 of the corresponding retaining groove 28 lying opposite it.

A rotor blade 10 which is inserted in the rotor disk 25 bears essentially against the surface regions which are identified by A, A' and B, B', during rotation of the rotor. These surface regions form the bearing flanks A, A' and B, B' of the rotor blade 10 and of the retaining groove 28 so that the rotor blade 10 is secured against radial movements. On account of the matching arrangement of the curvature of the blade root 16 and the rotational direction R of the rotor, an increase of the stress loading in the regions A, A', B, B' can be avoided. Of particular advantage in this case is that on both sides of the blade root center line 24 the centers of the respective bearing flanks A, B lie upon different radii $R_1$, $R_2$. As a result, the effect is achieved of the distance between the two centers being greater than in that case when they lie on an equal radius, which overall increases the fictive failure crack length.

Figure 3:
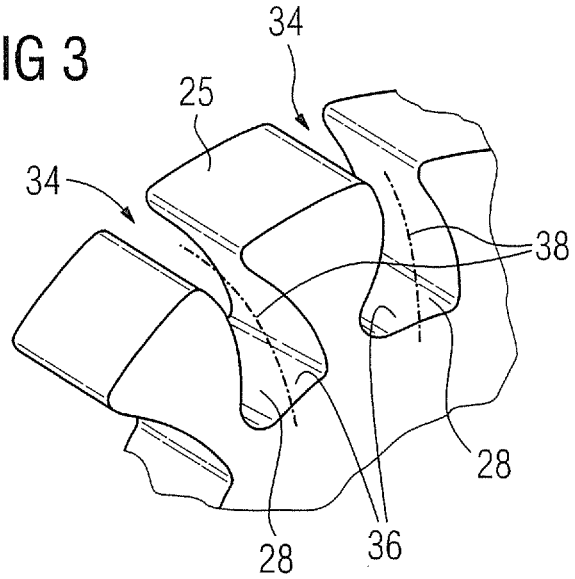
FIG. 3 shows in a perspective view a detail of the rotor disk according to FIG. 2.

FIG. 3 shows a rotor disk 25 which is analogous to FIG. 2 and in which the retaining grooves 28 extend obliquely in relation to the axial direction.

Figure 4:
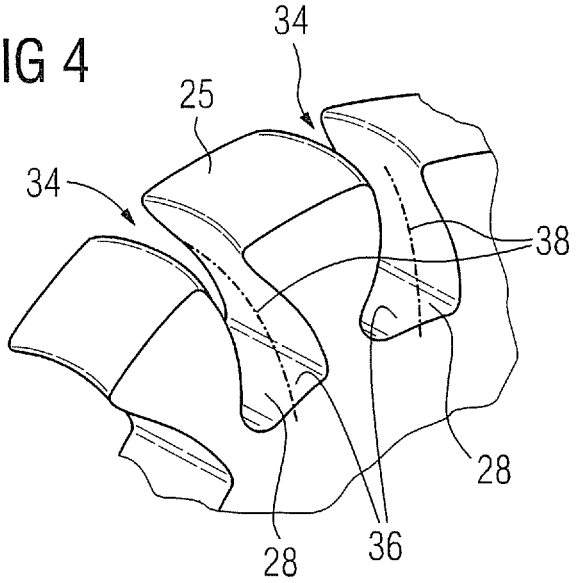
FIG. 4 shows a rotor disk in a development which is alternative to FIG. 3, with curved retaining grooves in the axial direction.

In FIG. 4, the retaining grooves 28 have a curved contour along the axial direction. Accordingly, the blade root of a rotor blade corresponding thereto is then additionally curved in the axial direction.

Each of the rotor blades 10 described here can be designed as a turbine rotor blade or as a compressor blade, for example.

In all, the invention discloses a rotor blade 10 for an axial flow turbomachine, preferably a turbine, in which for reducing the mechanical load in the blade root 16 and in the walls 30, 32 of a rotor supporting this blade root, the two mutually opposite sidewalls 20, 22 of the blade root 16 are continuously curved along their extent between the platform 14 and the blade root underside 18.

The invention claimed is:

1. A rotor blade for an axial flow turbomachine, comprising:

a curved blade airfoil;

a platform with a platform surface; and a dovetail-shaped blade root with two mutually opposite sidewalls which diverge from the platform towards a blade root underside, the spacing of which becomes larger with increasing distance from the platform, wherein a longitudinal axis of the rotor blade is arranged perpendicularly to the platform surface in the region of the connection between the blade airfoil and the platform, wherein both sidewalls are curved essentially in the same direction along their extent between the platform and the blade root underside in such a way that a blade root center line, which is arranged in the middle between the two sidewalls, is curved in the corresponding direction, as seen in cross section, and wherein a first curvature of a first sidewall of the blade root which in the rotational direction of a rotor of a turbomachine equipped with such a rotor blade, is leading in relation to a second sidewall, and is mostly convex, and wherein a second curvature of the second sidewall, which is correspondingly trailing in relation to the first sidewall, is mostly concave.

2. The rotor blade as claimed in claim 1, wherein the blade root is curved in the axial direction.

3. The rotor blade as claimed in claim 1, wherein the rotor blade is designed as a turbine rotor blade of an axial flow turbomachine.

4. The rotor blade as claimed in claim 1, wherein the Rotor blade is designed as a compressor blade of an axial flow turbomachine.

5. A mounting for a rotor blade as claimed in claim 1, comprising:

a retaining groove for each rotor blade which is to be mounted, wherein the retaining groove includes two mutually opposite sidewalls in each case, which, for forming a dovetail shape, diverge from an outwardly oriented groove opening towards a groove base, the spacing of which becomes larger with increasing distance from the opening, wherein both sidewalls are essentially curved in the same direction along their extent between the groove opening and the groove base in such a way that a fictive retaining groove center line, which is arranged in the middle between the two sidewalls, is curved in the corresponding direction, as seen in cross section, and wherein a first curvature of a first sidewall of the retaining groove which, in the rotational direction of a rotor of a turbomachine equipped with such a mounting, is leading in relation to a second sidewall, and is essentially concave, wherein a second curvature of the second sidewall which is correspondingly trailing is essentially convex.

6. The mounting as claimed in claim 5, wherein the retaining groove is curved in the axial direction.

7. The mounting as claimed in claim 5, wherein the mounting is formed on the rotor of a turbine or compressor, and wherein two bearing flanks of the sidewalls of a respective retaining groove are arranged at least partially on different radii.

8. A rotor for a compressor or turbine comprising:

a mounting as claimed in claim 5, comprising:

a plurality of retaining grooves, wherein the plurality of retaining grooves of which a rotor blade, as claimed in claim 1, is arranged in each case.

9. The rotor as claimed in claim 8, wherein each retaining groove is curved in the axial direction.

10. The rotor as claimed in claim 8, wherein the mounting is formed on the rotor of a turbine or compressor, and wherein two bearing flanks of the sidewalls of a respective retaining groove are arranged at least partially on different radii.

* * * * *